US006711275B2

(12) United States Patent
Damerow et al.

(10) Patent No.: US 6,711,275 B2
(45) Date of Patent: Mar. 23, 2004

(54) COMBINED SPEAKER/DOME LAMP

(75) Inventors: Robert L Damerow, Garden City, MI (US); Rich Kelly, New Hudson, MI (US); Timothy L Bastian, New Hudson, MI (US); Daron Steward, Southfield, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 172 days.

(21) Appl. No.: 10/034,189

(22) Filed: Dec. 20, 2001

(65) Prior Publication Data

US 2003/0118206 A1 Jun. 26, 2003

(51) Int. Cl.[7] ..... H04R 25/00

(52) U.S. Cl. ..... 381/389; 381/302; 381/386; 381/86; 181/199

(58) Field of Search ..... 381/389, 302, 381/334, 335, 386, 86; 181/150, 199

(56) References Cited

U.S. PATENT DOCUMENTS 5,606,623 A * 2/1997 Bahm, III et al. ..... 381/86

* cited by examiner

*Primary Examiner*—Curtis Kuntz
*Assistant Examiner*—Tuân Duć Nguyêñ
(74) *Attorney, Agent, or Firm*—Thomas A. Jurecko

(57) ABSTRACT

A combination speaker and dome lamp assembly is adapted to be mounted at the intersection of a roll bar and side bar of a vehicle equipped with such bars, such as convertible off-road vehicles.

3 Claims, 3 Drawing Sheets

COMBINED SPEAKER/DOME LAMP

BACKGROUND OF THE INVENTION

The invention generally pertains to speakers and interior lighting systems for automotive vehicles. More particularly, the invention concerns combined speakers/dome light units for mounting to roll bars on vehicles equipped therewith.

Vehicles with roll bars, such as off-road convertible vehicles with hard or soft covers, are now being equipped with more and more luxury or convenience accessories, such as stereo sound systems and enhanced interior lighting. Such vehicles typically have fewer locations for mounting such accessories than the typical sedans or sport utility vehicles in the automotive industry.

This invention addresses the problem of secure and convenient mounting locations for a combination dome lamp and speaker housing.

SUMMARY OF THE INVENTION

Accordingly, a combination speaker and dome lamp adapted to be mounted to a roll bar of an automotive vehicle comprises a housing having forward, side and bottom surfaces, the bottom surface mounting a cover for the speaker and a cover for the dome lamp, the side surface terminating in a flange portion having fastener receiving holes adapted to overlie mating holes in a side mounting surface of the vehicle, and the forward surface having a protrusion extending therefrom and adapted to engage an opening in the roll bar of the vehicle. The housing is adapted for coupling to the roll bar by first inserting the protrusion into the roll bar opening and then fastening the flange portion to the side mounting surface via the fastener holes.

In another aspect of the invention, a combination speaker and dome lamp is adapted for mounting substantially at an intersection of a roll bar extending transversely of a vehicle chassis and a side bar extending longitudinally of the chassis. A housing having forward, side and bottom surfaces uses the bottom surface for mounting a cover for the speaker contained within the housing and a cover for the dome lamp contained within the housing. The side surface terminates in a flange portion having fastener receiving holes adapted to overlie mating holes in the side bar. The forward surface has a protrusion extending therefrom adapted to engage an elongated opening or slot in the roll bar. The housing is adapted to be coupled substantially at the intersection of the roll bar and the side bar by first inserting the protrusion into the elongated opening, sliding the protrusion along the opening until the receiving holes in the body flange portion overlie the mating holes in the side bar, and inserting fasteners through the receiving and mating holes.

BRIEF DESCRIPTION OF THE DRAWINGS

The objects and features of the invention will become apparent from a reading of a detailed description, taken in conjunction with the drawing, in which.

DETAILED DESCRIPTION OF THE PREFERRED EMBODIMENTS

Figure 1:
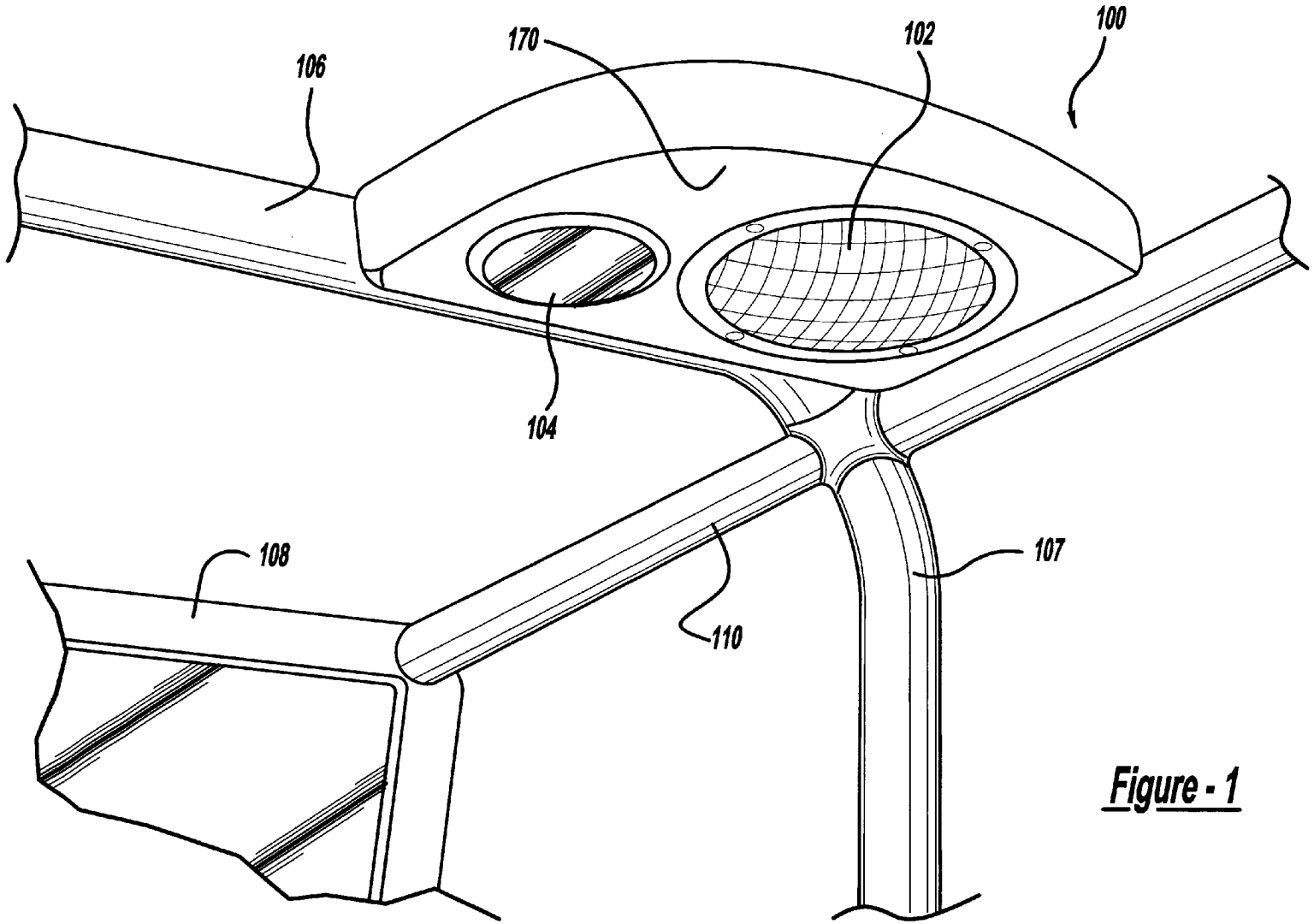
FIG. 1 is a perspective view taken from below and rearwardly of a combined speaker and dome light housing arranged in accordance with the principles of the invention.
Figure 2:
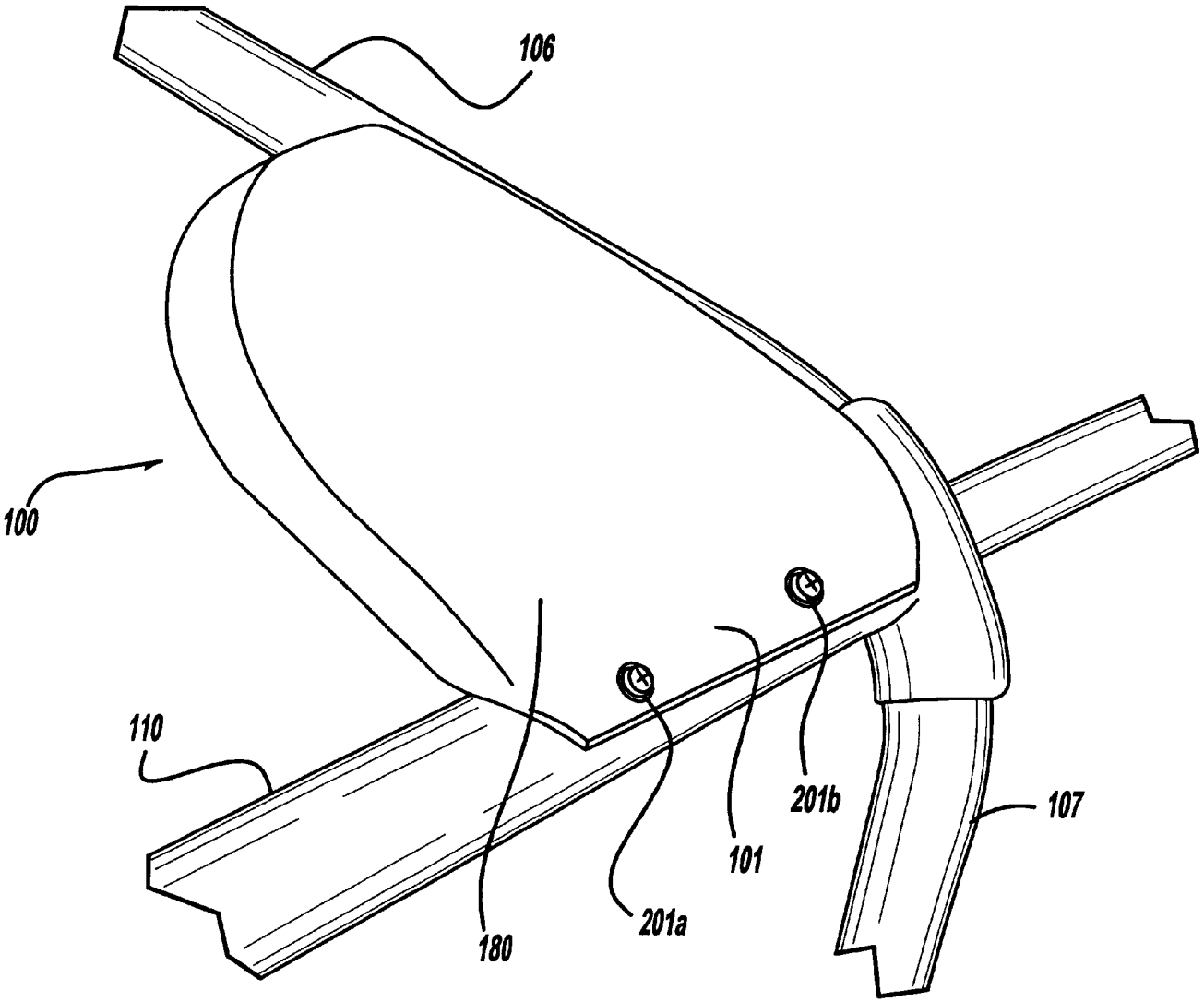
FIG. 2 is a top perspective view of the housing of FIG. 1.
Figure 3:
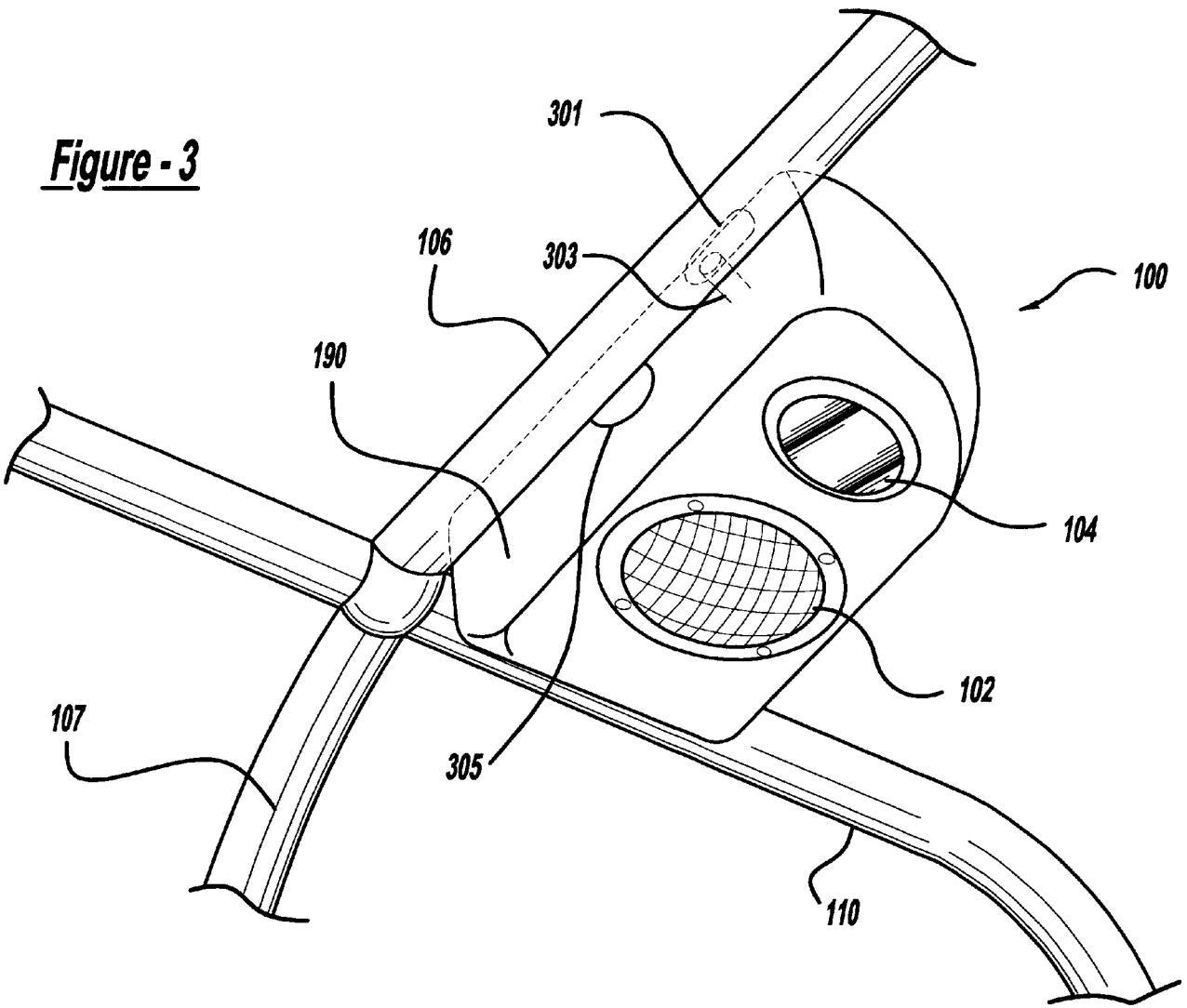
FIG. 3 is a bottom perspective view of the housing of FIG. 1 facing rearwardly of the vehicle the housing of FIG. 1.

With reference to FIGS. 1–3, a combination speaker and dome lamp assembly is enclosed in a plastic, blow-molded housing 100. Housing 100 is designed to fit on the roll bar 106 of an automotive vehicle equipped with such apparatus.

Housing 100 is adapted to be coupled substantially at the intersection of the vehicle's side bar 110 and roll bar 106 which extends past the intersection downwardly as the B-pillar 107 of the vehicle.

Side bar 110 extends substantially longitudinally of the vehicle from a windshield frame 108 rearwardly, while roll bar 106 extends substantially transversely of the vehicle chassis to another side bar, not shown at an opposite side of the chassis.

Housing 100 has a forward surface 190, a bottom surface 170 and a side surface 180. Forward surface 190 includes a protrusion 303 which extends therefrom for engagement with a slot or elongated opening 301 in roll bar 106. Protrusion 303 could, for example, comprise a removable threaded bolt threadingly coupled to the housing 100 at one end and extending outwardly from front surface 190.

Bottom surface 170 provides the mounting surface for dome lamp cover 104 and speaker cover 102. While only one housing 100 is shown in the drawing, it is to be understood that in a conventional stereo sound system arrangement, identical housings 100 would be mounted at opposite sides of the vehicle at the respective intersections of the side bars with the roll bar 106.

Housing 100 additionally includes a side surface 180 which terminates in a flange portion 101. Flange 101 includes openings 201*a* and 201*b* for receipt of appropriate fastening elements, such as threaded bolts, which, in turn, are positioned to engage mating holes in side bar 110 underlying holes 201*a* and 201*b* in flange portion 101.

A depression or cup 305 is also formed in the forward surface 190 for mounting a connector for mating engagement with a plug extending from and opening (not shown) in roll bar 106 for appropriate electrical connections from the vehicle's electrical supply and/or sound communication wiring systems.

With the arrangement shown in FIGS. 1–3, housing 101 provides for stereo sound, light, and rear occupant head impact protection at substantial cost and weight savings. The slide-in protrusion feature eliminates the need for a bolt or screw-type fastener between housing 100 and roll bar 106 and therefore greatly speeds up and simplifies assembly line installation of housing 100.

Protrusion 301 may optionally be provided with an encircling sheath fashioned from a suitable plastic material to minimize objectionable rattling noises that would otherwise possibly be created by the metal protrusion 303 moving against a periphery of opening 301 in roll bar 106 as the vehicle is in motion. Alternatively, protrusion 303 could be fashioned entirely of a sound-deadening material. Indeed, protrusion 303 could be an integral extension of molded housing 100.

The invention has been described with reference to an embodiment set forth for the purposes of example only. The scope and spirit of the invention is to be derived from an appropriate interpretation of the appended claims.

What is claimed is:

1. A combination speaker and dome lamp adapted for mounting substantially at an intersection of a roll bar extending transversely of a vehicle chassis and a side bar extending longitudinally of the chassis, the combination comprising:

a housing having forward, side and bottom surfaces, the bottom surface mounting a cover for the speaker contained within the housing and a cover for the dome lamp contained within the housing, the side surface terminating in a flange portion having fastener receiving holes adapted to overlie mating holes in the side bar, and a forward surface having a protrusion extending therefrom and adapted to engage an elongated opening in the roll bar, whereby the housing is adapted to be coupled substantially at the intersection of the roll bar and side bar by first inserting the protrusion into the elongated opening, sliding the protrusion along the opening until the receiving holes in the body flange portion overlie the mating holes in the side bar, and inserting fasteners through the receiving and mating holes.

2. The combination of claim 1 wherein the protrusion is surrounded by a plastic sleeve.

3. The combination of claim 1 wherein the protrusion comprises a removable, threaded bolt extending from the forward surface.

* * * * *

UNITED STATES PATENT AND TRADEMARK OFFICE

CERTIFICATE OF CORRECTION

PATENT NO. : 6,711,275 B2
DATED : March 23, 2004
INVENTOR(S) : Damerow et al.

It is certified that error appears in the above-identified patent and that said Letters Patent is hereby corrected as shown below:

Title page,
Item [75], Inventors, "Rich Nelly, New Hudson, MI (US)" should be
-- Rich Kelly, Bryron, MI (US) --

Signed and Sealed this

Twenty-fourth Day of August, 2004

JON W. DUDAS
*Director of the United States Patent and Trademark Office*